US006374769B1

(12) United States Patent
Pesavento et al.

(10) Patent No.: US 6,374,769 B1
(45) Date of Patent: Apr. 23, 2002

(54) FLUID MATERIAL APPLICATION SYSTEM EMPLOYING TUBE-IN-HOSE HEAT EXCHANGER

(75) Inventors: Eugene R. Pesavento; Duane R. Mueller, both of Wausau; Michael A. Schmelzer, Appleton, all of WI (US)

(73) Assignee: Fort James Corporation, Deerfield, IL (US)

( * ) Notice: Subject to any disclaimer, the term of this patent is extended or adjusted under 35 U.S.C. 154(b) by 0 days.

(21) Appl. No.: 09/397,736

(22) Filed: Sep. 17, 1999

Related U.S. Application Data

(60) Provisional application No. 60/100,727, filed on Sep. 17, 1998.

(51) Int. Cl.[7] ..... B05C 1/08

(52) U.S. Cl. ..... 118/46; 118/58; 118/69; 118/602; 118/202; 118/249; 118/259; 101/487

(58) Field of Search ..... 118/58, 602, 101, 118/202, 244, 249, 259, 69, 666, 667, 46; 101/487; 137/340

(56) References Cited

U.S. PATENT DOCUMENTS

| | | | | |
|---|---|---|---|---|
| 4,232,735 A | | 11/1980 | Kim et al. | |
| 4,286,653 A | | 9/1981 | Edwards | |
| 4,340,895 A | | 7/1982 | Kikuchi | |
| 4,354,548 A | | 10/1982 | Carlsson | |
| 4,377,815 A | | 3/1983 | Henning et al. | |
| 4,412,233 A | | 10/1983 | Thomas et al. | |
| 4,424,624 A | | 1/1984 | Sievers | |
| 4,588,026 A | | 5/1986 | Hapgood | |
| 4,611,655 A | | 9/1986 | Molignoni | |
| 4,697,636 A | | 10/1987 | Mellsjö | |
| 4,778,002 A | | 10/1988 | Allgäuer et al. | |
| 4,781,246 A | | 11/1988 | Golben | |
| 4,786,015 A | | 11/1988 | Niggemann | |
| 4,821,797 A | | 4/1989 | Allgäuer et al. | |
| 4,879,951 A | | 11/1989 | Yoshida et al. | |
| 4,902,476 A | | 2/1990 | Gordon et al. | |
| 4,932,353 A | * | 6/1990 | Kawata et al. | 118/666 |
| 5,004,047 A | | 4/1991 | Meier et al. | |
| 5,046,420 A | | 9/1991 | Sondergeld et al. | |
| 5,127,441 A | | 7/1992 | Rains | |
| 5,146,946 A | * | 9/1992 | Maugans | 137/340 |
| 5,272,971 A | | 12/1993 | Fredericks | |

(List continued on next page.)

FOREIGN PATENT DOCUMENTS

CA 779817 3/1968

OTHER PUBLICATIONS

An Article entitled, "Coatings Simplified: The Why & How of Ultrakote".
Chiller Product Catalog (1996).

*Primary Examiner*—Laura Edwards
(74) *Attorney, Agent, or Firm*—Nixon Peabody LLP

(57) ABSTRACT

A fluid material application system is provided with an application deck for applying a fluid material that includes printing ink, adhesive or coating, a source of fluid material, a source of heat transfer liquid, and a heat exchanger. The heat exchanger includes a tube-in-hose ink heat exchange element having a fluid material carrying seamless tube located within a hose. The hose is adapted to be connected to a heat transfer fluid source so that a heat transfer fluid flows around the fluid material carrying tube to control and maintain the temperature of the fluid material in the tube at a generally constant temperature. The elongated heat exchange element may possess a winding type of configuration (e.g., it may be coiled or helically wound or may be laid out in a serpentine path) to define a winding flow path for the fluid material and the heat transfer fluid, and may be located within an enclosing structure to define an overall compact heat exchanger.

20 Claims, 6 Drawing Sheets

U.S. PATENT DOCUMENTS 5,287,913 A * 2/1994 Dunning et al. ..... 137/340
5,295,437 A 3/1994 Philippe
5,384,160 A 1/1995 Frazzitta
5,465,661 A 11/1995 White
5,520,739 A 5/1996 Frazzitta
5,571,563 A 11/1996 Helms et al.
5,603,261 A 2/1997 Buenz
5,689,971 A 11/1997 Kuhlenschmidt et al.
5,691,754 A 11/1997 Ta

* cited by examiner

FLUID MATERIAL APPLICATION SYSTEM EMPLOYING TUBE-IN-HOSE HEAT EXCHANGER

This application is based on and claims priority under 35 U.S.C. § 119(e) with respect to U.S. Provisional Application No. 60/100,727 filed on Sep. 17, 1998, the entire content of which is incorporated herein by reference.

FIELD OF THE INVENTION

The present invention generally relates to a heat exchanger. More particularly, the present invention pertains to a heat exchanger for controlling the temperature of fluid inks and other liquids containing emulsions, suspensions or dissolved solids.

BACKGROUND OF THE INVENTION

Fluid inks are commonly used in the printing industry for flexographic printing and rotogravure printing. These fluid inks include water based fluid inks, solvent based fluid inks and ultraviolet curable inks. One important consideration in fluid ink printing is the viscosity of the fluid ink. The fluid ink should be maintained at a certain viscosity to avoid problems during the printing process and to optimize the printing process.

However, as the fluid ink is pumped to the printing deck, the ink becomes heated because of, for example, heat produced at the ink applicator, heat produced by hot air driers, the pumping of the fluid through the pump, and other sources as well. This heating of the fluid ink can be quite problematic. Water based fluid inks are typically stabilized by amines and at higher temperatures, the amines tend to evaporate. This causes the ink to become unstable.

Solvent based fluid inks commonly include a solvent which, when excessively heated, flashes off and causes the ink to become more viscous than desired for optimum printing quality. Also, health and environmental concerns arise when solvent based fluid ink is heated so that the solvent flashes off.

Ultraviolet curable inks are a bit different in that they are commonly made almost entirely of solids. Thus, these types of fluid inks must be heated to a specified temperature to ensure quality printing.

In each of the fluid inks mentioned above, it is thus desirable to maintain the temperature of the fluid ink at a generally constant temperature to help ensure optimum printing quality and avoid potential health and environmental concerns. Thus, it has been proposed to use a heat exchanger in an attempt to control the temperature of the fluid inks within a desired range. However, the heat exchangers typically used in this regard have been found to be susceptible of a variety of problems. Plate type heat exchangers and multi-tube heat exchangers possess many convoluted surfaces and welded seams that readily collect ink solids. Thus, when the operation of the printing deck is stopped so that the flow of ink through the heat exchanger ceases, ink can collect on these surface and dry. The resulting ink solids can be extremely difficult to remove from the heat exchangers.

Another type of heat exchanger that has been used in the past is a jacketed ink sump that involves the use of a double walled sump with a heat transfer fluid between the two walls. These types of heat exchangers are also quite difficult to clean and suffer from the additional disadvantage that they must typically be disconnected from the heat transfer supply source. Also, these types of heat exchangers are rather heavy, difficult to clean, and inefficient and not well suited to effecting adequate cooling.

A further type of heat exchanger that has been used in this context is one in which a cooling coil is located directly in the ink sump. This type of system tends to be rather cumbersome. Also, this system suffers from the disadvantage that the cooling coil must be cleaned, a task that can be quite time consuming and messy.

In light of the foregoing, a need exists for a heat exchanger that is able to maintain the temperature of fluid inks and other liquids containing emulsions, suspensions and dissolved solids at a substantially constant temperature while at the same time being easy to clean, compact in design and relatively simple in construction.

SUMMARY OF THE INVENTION

In accordance with one aspect of the invention, a fluid material application system for applying printing ink, adhesive or a coating to a paper product includes a fluid material source containing fluid material in the form of fluid ink, adhesive or a coating, a heat transfer fluid source containing heat transfer fluid, and a heat exchanger that includes a heat exchange element comprised of a hose for carrying the heat transfer fluid and a tube for carrying the fluid material. The tube is positioned within the hose and the heat exchange element possesses a winding configuration with adjacent portions of the heat exchange element resting on top of one another so that the adjacent portions are supported in a vertical fashion. An application deck is adapted to apply the fluid material to a paper product and a fluid material introduction conduit connects the fluid material source to the inlet of the tube to carry the fluid material from the fluid material source to the heat exchanger. A fluid material supply conduit connects the outlet of the tube to the application deck to carry fluid material from the heat exchanger to the application deck, a heat transfer fluid supply conduit connects the heat transfer fluid source to the inlet of the hose to carry heat transfer fluid to the heat exchange element, a heat transfer fluid return conduit connects the outlet of the hose to the heat transfer fluid source to carry heat transfer fluid from the heat exchange element to the heat transfer fluid source, and a fluid material return conduit connects the application deck to the fluid material source to return fluid material from the application deck to the fluid material source.

According to another aspect of the invention, a fluid material application system for applying one printing ink, adhesive or a coating to a substrate includes a fluid material source containing fluid material in the form of printing ink, adhesive or a coating, a heat transfer fluid source, and an application deck for applying the fluid material to a substrate, with the application deck being connected to the fluid material source. A heat exchange element is also provided and is comprised of a tube positioned within a hose so that the central axis of the tube is generally parallel to the central axis of the hose. The tube is connected to the fluid material source to carry the fluid material through the heat exchange element and the hose is connected to the heat transfer fluid source to carry heat transfer fluid through the heat exchange element.

BRIEF DESCRIPTION OF THE DRAWING FIGURES

Additional features and characteristics of the present invention will become more apparent from the following detailed description considered with reference to the accompanying drawing figures in which like elements are designated by like reference numerals and wherein.

DETAILED DESCRIPTION OF THE INVENTION

Generally speaking, the present invention provides a fluid material application system that applies a fluid to a substrate, for example paper products including polymer coated paper products. The fluid material application system includes a heat exchanger referred to as a tube-in-hose heat exchanger. The heat exchanger is useful in connection with fluid ink printing systems involving, for example, flexographic printing and rotogravure printing. The present invention is also applicable to applicators for applying other fluid or liquid materials (e.g., coatings and adhesives) which contain suspensions, emulsions or dissolved solids which are susceptible to producing dried solids in the presence of surfaces and seams upon which the liquid can collect and in which temperature control of the material is necessary or desirable. Thus, the heat exchanger can be used in connection with fluid material application systems for applying adhesives and coatings including flexographic, gravure, hydrophilic and rod coaters.

The tube-in-hose ink heat exchanger includes a fluid (liquid) material carrying tube positioned within a heat transfer fluid carrying hose. The fluid material carrying tube is connected to a fluid material supply source while the hose is connected to a source of heat transfer fluid. The heat transfer fluid (liquid) flows around the outside of the ink carrying tube to control and maintain the temperature of the fluid material generally constant, thereby avoiding problems associated with changes in fluid material viscosity or the fluid material being insufficiently heated.

Figure 1:
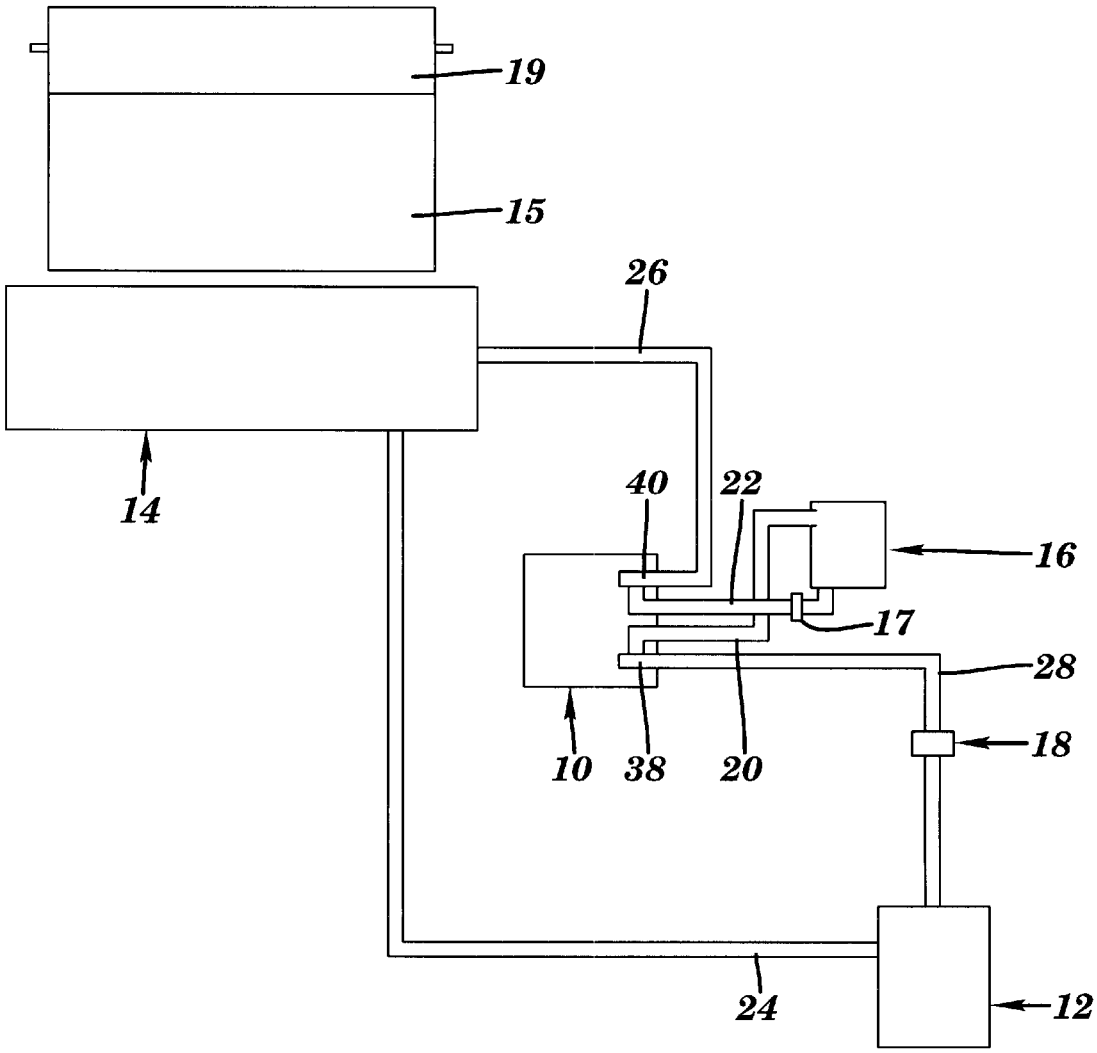
FIG. 1 is a schematic illustration of a fluid ink printing system that embodies the ink heat exchanger of the present invention.

Referring initially to FIG. 1, the heat exchanger of the present invention is illustrated as being used in a fluid ink printing system such as flexographic printing or rotogravure printing. As schematically shown in FIG. 1, the heat exchanger 10 is positioned between a source or supply of fluid or liquid ink 12 and a printing deck 14. Fluid ink supplied is supplied from the ink source 12 to the heat exchanger 10 by way of a pipe or conduit 28, with the fluid ink being pumped to the heat exchanger 10 through operation of a pump 18. The fluid ink is then supplied from the heat exchanger 10 to the printing deck 14 by way of a pipe or conduit 26 whereupon the fluid ink is applied to a printing plate which is then transferred to a substrate. Typically, only a fraction of the fluid ink is used in the printing deck 14 and so the residual fluid ink is returned to the ink source 12 by way of a pipe or conduit 24.

The printing system also includes a source of heat transfer fluid (liquid such as water) 16. The heat transfer fluid is conveyed from the source 16 to the heat exchanger 10 by way of a conduit or pipe 22. A pump 17 is provided in the conduit 22 to pump heat transfer fluid to the heat exchanger 10. The heat transfer fluid that has passed through the heat exchanger 10 is conveyed back to the heat transfer fluid source 16 by way of a pipe or conduit 20.

Figure 2:
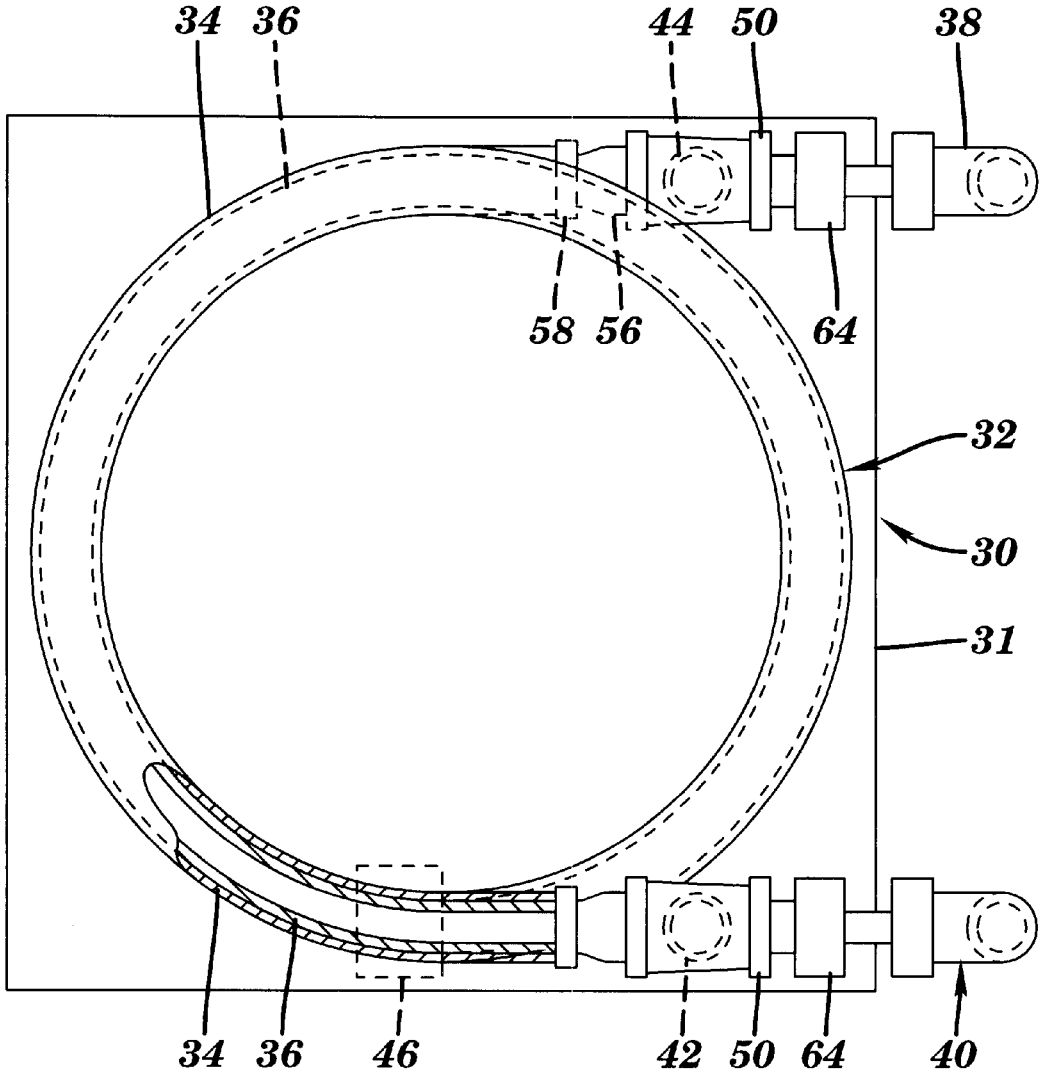
FIG. 2 is a top view of the ink heat exchanger according to the present invention.
Figure 3:
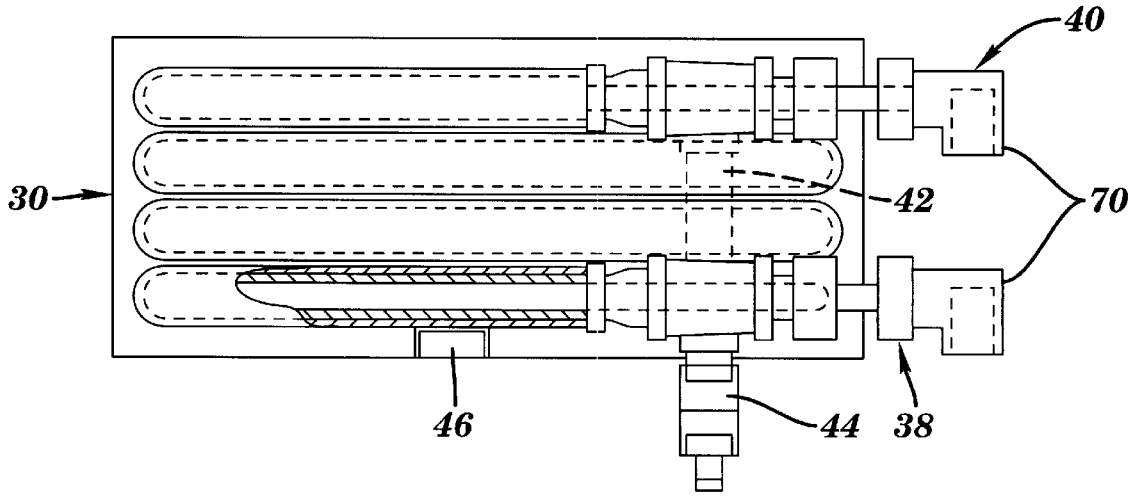
FIG. 3 is a side view of the ink heat exchanger according to the present invention.

The details and features associated with the heat exchanger 10 of the present invention are illustrated in FIGS. 2 and 3. As seen in FIG. 2, the heat exchanger includes a generally rectangular box 30 that houses a heat exchange element 32. The box 30 is preferably made of stainless steel, although other materials are possible. The interior of the box 30 can be made accessible by making one of the walls removable. In the illustrated embodiment, the front wall 31 is removable and can be secured in place by bolts with nuts welded to the inside of the box. The box also serves as an insulator for the heat exchange element 32.

Figure 4:
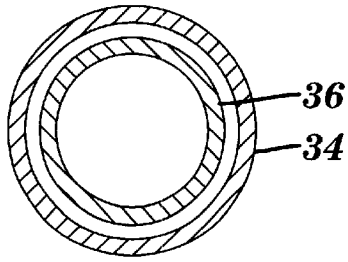
FIG. 4 is a cross-sectional view of the tube and hose portion of the heat exchanger of the present invention.

The heat exchange element 32 is formed as a tube-in-hose element that includes a tube 36 for carrying ink and a hose for carrying a heat transfer fluid. The tube 36 is located generally coaxially within the hose 34, with the central axis of the tube 36 being generally parallel to the central axis of the hose 34. As seen in FIG. 4, the outer diameter of the tube 36 is less than the inner diameter of the hose 34.

The heat transfer fluid carrying hose 34 is preferably made of spiral reinforced PVC, although other flexible materials such as rubber and other polymeric materials are possible. For example, the hose 34 can be made of polymer material possessing flexibility characteristics. The use of a hose made of spiral reinforced PVC, rubber or other appropriate flexible material is beneficial in several respects. First, this construction makes it much easier to form the heat exchange element into a winding shape (e.g., a coiled or helical shape or a serpentine shape). Also, the hose serves as an insulator. Further, the hose can function as a pressure vessel. This allows the selection of a hose having strength characteristics designed to meet the operating parameters relating to the heat transfer fluid.

The ink carrying tube 36 is a seamless tube that is preferably made of metal having a high heat transfer coefficient. Copper is a particularly advantageous material from the standpoint of ease in fabrication, although stainless steel is preferred in the context of ink applications because copper might have a tendency to corrode. The use of a seamless tube 36 for carrying ink is particularly advantageous because the absence of seams and other convoluted surfaces eliminates possible regions in which ink solids can collect, thus avoiding problems during cleaning.

One end of the ink carrying tube 36 is connected to an ink inlet fitting 38 while the opposite end of the ink carrying tube 36 is connected to an ink outlet fitting 40. The ink inlet fitting 38 is adapted to be connected to the conduit 28 shown in FIG. 1 that extends from the ink source 12 to the heat exchanger 10. The ink outlet fitting 40 is adapted to be connected to the conduit 26 shown in FIG. 1 that extends from the heat exchanger 10 to the printing deck 14. In the embodiment shown in FIGS. 2 and 3, the ink outlet fitting 40 and the ink inlet fitting 38 extend through the same side wall of the box 30.

One end of the heat transfer fluid carrying hose 34 is connected to a heat transfer fluid inlet fitting 42 while the opposite end of the heat transfer fluid carrying hose 34 is connected to a heat transfer fluid outlet fitting 44. The heat transfer fluid inlet fitting 42 is adapted to be connected to the conduit 22 shown in FIG. 1 that extends between the source 16 of heat transfer fluid and the heat exchanger 10. The heat transfer fluid outlet fitting 44 is adapted to be connected to the conduit 20 shown in FIG. 1 that extends between the heat exchanger 10 and the source 16 of heat transfer fluid. The heat transfer fluid inlet fitting 42 and the heat transfer fluid outlet fitting 44 both extend through the bottom wall of the box 30.

The heat transfer fluid inlet 42 is connected to the end of the hose 34 that is located adjacent the ink outlet 40 while the heat transfer fluid outlet 44 is connected to the end of the hose 34 that is located adjacent the ink inlet 40. This produces a counter flow of heat transfer fluid relative to the ink. That is, the ink within the tube 36 and the heat transfer fluid within the hose 34 flow in opposite directions. This arrangement helps optimize the heat transfer process.

As can be seen from FIG. 3, the ink inlet fitting 38 is positioned near the bottom of the box 30 while the ink outlet fitting 40 is positioned near the top of the box 30. Positioning the ink inlet fitting 38 at the bottom of the box 30 and the ink outlet fitting 40 at the top of the box 30 is highly beneficial in that the ink in the ink carrying tube 36 can be easily drained from the tube 36 by turning off the pump 18 and allowing the ink to drain from the outlet end to the inlet end (i.e., from top to the bottom) by gravity. It is, of course, possible to drain the ink by reversing the operation of the pump and using gravity assist.

The heat exchange element 32 comprised of the ink carrying tube 36 and the heat transfer fluid carrying hose 34 is helically wound within the box 30 in a coiled or spiraling fashion. As seen in FIG. 3, the adjacent coils forming the helically coiled heat exchange element 32 rest on top of one another so that the coils are all supported in a vertical fashion. This arrangement allows a relatively long heat exchange element 32 to be used (e.g., on the order of at least 20 feet) to achieve significant heat exchange capability while also permitting the heat exchanger to possess a relatively compact overall construction.

The bottom of the box 30 is preferably provided with a bracket 46 that supports the lowermost coil of the heat exchange element 32 to ensure that the coil remains level (i.e., horizontal). The bottommost coil is spaced from the bottom surface of the box 30 by virtue of the configuration of the ink inlet 38 and the heat transfer fluid outlet 44. Thus, in the absence of the bracket 46, the coil would tend to sag, thus making it difficult for the fluid ink to fully and completely drain from the tube 36. The bracket 46 is preferably located at generally the six-o-clock position as shown in FIG. 2 and possesses a height generally equal to one-half the outer diameter of the hose 34.

Figure 5:
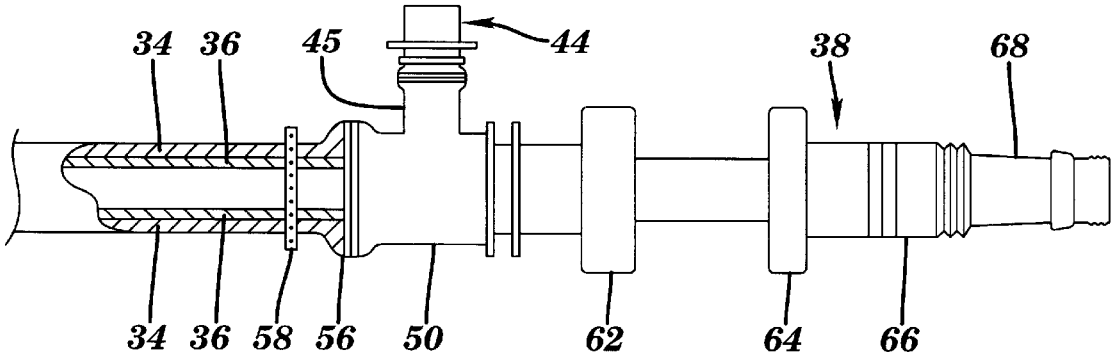
FIG. 5 is an enlarged side view of the connection for connecting the ink inlet and outlet to the ink supply and return conduits, and for connecting the heat transfer fluid inlet and outlet with the heat transfer fluid supply and return conduits.

As described above, the ink carrying tube 36 is a seamless tube. This thus eliminates possible areas in which ink solids could otherwise collect and make cleaning the tube difficult. The connection of the ink inlet fitting 38 and the ink outlet fitting 40 to the opposite ends of the ink carrying tube 36 is also designed with similar considerations in mind. FIG. 5 illustrates the way in which the ink inlet fitting 38 is connected to the end of the ink carrying tube 36 and the way in which one end of the heat transfer fluid carrying hose 34 is connected to the heat transfer fluid outlet fitting 44. It is to be understood that the connection of the ink outlet fitting 40 to the other end of the ink carrying tube 36 and the connection of the opposite end of the heat transfer fluid carrying hose 34 to the heat transfer fluid inlet fitting 42 is the same as shown in FIG. 5.

As shown in FIG. 5, the end of the heat transfer fluid carrying hose 34 is connected to an adapter 56 by way of a hose clamp 58 which ensures a tight connection to the end of the hose 34. The adapter 56 is in turn connected to a tee connector 50. The end portion of the ink carrying tube 36 passes through this tee connector 50. The side leg 45 of the tee connector 50 is connected to the fitting 44 which in turn is connected to the conduit 20 shown in FIG. 1 which returns heat transfer fluid to the heat transfer fluid source 16.

A compression fitting 62 is connected to the tee connector 50. This fitting 62 is provided with a hole through which the ink carrying tube 36 passes, with the fitting 62 being sized to tightly engage the outer periphery of the ink carrying tube 36 to provide a liquid tight seal. The end of the ink carrying tube 32 is engaged by a compression fitting 64. A coupling 66 is connected to the compression fitting 64 for accommodating a quick connect fitting 68 that is to be connected to the end of the conduit 38 shown in FIG. 1. Of course, the compression fitting 64 can also be directly connected to the quick connect fitting 68.

In operation, fluid ink is pumped from the fluid ink source 12 to the heat exchanger 10 by way of the pump 18. The fluid ink is pumped through the ink carrying tube 36 from the bottom of the heat exchanger 10 towards the top of the heat exchanger 10. The fluid ink is then conveyed to the printing deck 14 as shown in FIG. 1 for printing onto, for example, a paper product 15 that is being unwound from a roll 19. As the fluid ink is being pumped through the heat exchanger 10, heat transfer fluid is supplied from the heat transfer fluid source 16 by way of the conduit 22. The heat transfer fluid flows through the heat transfer fluid carrying hose 34 in the direction opposite the direction of flow of the fluid ink in the ink carrying tube 36 (i.e., from the top of the heat exchanger towards the bottom of the heat exchanger). This flow of the heat transfer fluid over the outer surface of the ink carrying tube 36 as ink is flowing through the tube 36 causes heat exchange to occur. In the case of, for example, water based fluid inks and solvent based fluid inks that are susceptible to problems when heated, the heat transfer fluid would be a cooling fluid, for example in the form of water. In the case of ultraviolet curable inks, the heat transfer fluid could be a heated fluid to heat the ultraviolet curable ink to the desired temperature. In either case, the heat exchanger 10 is designed to maintain the fluid ink at a constant or generally constant temperature. It has been found that with a system in accordance with the present invention that utilizes a heat exchange element 32 of adequate length (e.g., about 20 feet), it is possible to control the temperature of the fluid ink so that, within several degrees (e.g., approximately 3–5°), the temperature of the ink flowing out of the heat exchanger 10 corresponds to the temperature of the heat transfer fluid flowing into the heat exchanger 10. Thus, the desired temperature of the fluid ink flowing out of the heat exchanger 10 can be achieved by appropriately selecting the temperature of the heat transfer fluid flowing into the heat exchanger.

The heat exchange element 32 preferably possesses a length of at least about 20 feet, with such a length being useful for narrow web printing presses (webs of about 10–30 inches in width). However, heat exchange elements of larger length, on the order up to 60 feet, are preferred for wide web printing presses (webs greater than about 30 inches in width). The length of the hose 34 is thus dependent upon the size of the press and the heat load on the ink, it also being recognized that some processes such as rotogravure printing typically require more heat exchange than flexographic printing. Also, the diameter or size of the ink carrying tube 36 is preferably selected based on the rate of flow of the ink into and out of the printing stand.

As noted above, the ink carrying tube 36 is preferably made of stainless steel in the case of fluid ink applications whereas the heat transfer fluid carrying hose 34 is preferably made of spiral reinforced PVC, although other materials such as rubber and other polymeric materials can also be used. The various connections for the ink carrying tube 36 are also preferably made of stainless steel while brass connections are used for the connections for the heat transfer fluid carrying hose 34. Other materials such as various plastics, e.g., polymers, are of course also possible for the connections so long as the material is able to properly function in a particular application.

The hose working pressure is preferably on the order of 125 psi, and the hose temperature range is preferably on the order of −40° F. to +150° F.

Other variations on the above-described heat exchanger are also possible. For example, 90° compression fittings 70 similar to those shown in FIGS. 2 and 3 can be provided at the ends of the ink inlets and outlets 38, 40 as an alternative to the straight compression fitting shown in FIG. 5. Also, while FIGS. 2 and 3 illustrate only the end portions of the ink inlet and ink outlet fittings being positioned exterior of the box 30, it is possible to configure the inlet and outlet fittings so that more of the connection mechanism extends out of the box. For example, the heat exchanger can be designed so that the entire connection up to and including the tee connector 50 is located exterior of the box.

FIGS. 6A–6H illustrate alternative ink connection orientation options to the particular ink connection option shown in FIGS. 2 and 3. The illustrations in FIGS. 6A–6H are top views of the heat exchanger. The designation U represents the upper fitting and the designation L represents the lower fitting. In each of the illustrations in FIGS. 6A–6H, the arrow pointing towards the heat exchanger represents the ink inlet and the arrow pointing away from the heat exchanger represents the ink outlet.

Figure 6A:
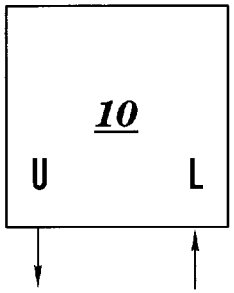
FIGS. 6A–6H are schematic illustrations of alternative heat exchanger configurations showing different possible locations for the ink inlet and the ink outlet.

In FIG. 6A, the heat exchanger 10 is much like that shown in FIGS. 2 and 3 where the ink inlet and outlet fittings are provided on the same side of the box. In FIG. 6B, the heat exchanger 100 is designed so that the ink inlet and outlet are provided on the same side of the box once again, but the positions of the ink inlet and the ink outlet are switched.

Figure 6C:
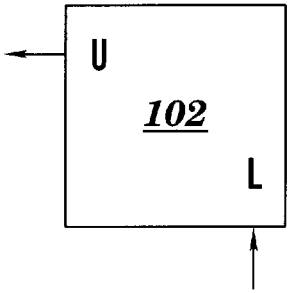

In the embodiment of the heat exchanger 102 shown in FIG. 6C, the ink inlet and the ink outlet are provided on different sides of the box, specifically sides that adjoin one another. The ink inlet and outlet fittings are located at positions on respective sides that are spaced most remote from one another. In FIG. 6D, the heat exchanger 104 is similar to that shown in FIG. 6C except that the positions of the ink inlet and the ink outlet are simply reversed with respect to those shown in FIG. 6C.

Figure 6E:
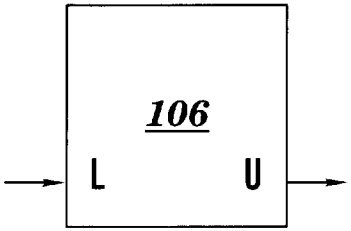

In FIG. 6E, the ink inlet and the ink outlet are provided on opposite side walls of the box forming the heat exchanger 106. In FIG. 6F, the heat exchanger 108 is similar to that shown in FIG. 6E, but the positions of the ink inlet fitting and the ink outlet fitting are once again reversed with respect to those shown in FIG. 6E.

Figure 6G:
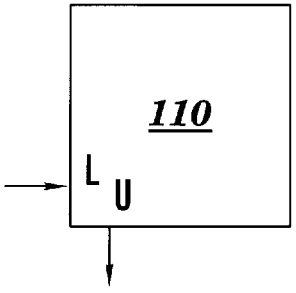
Figure 6B:
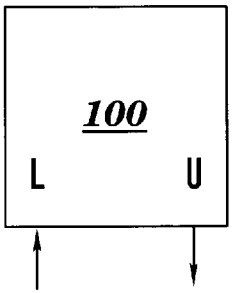
Figure 6D:
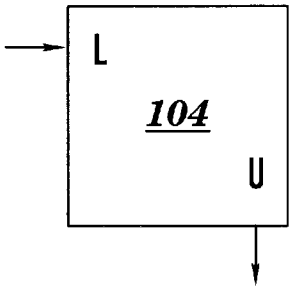
Figure 6F:
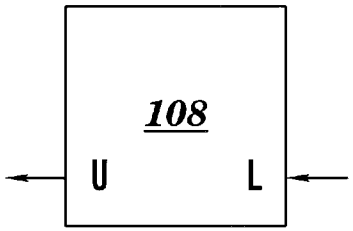
Figure 6H:
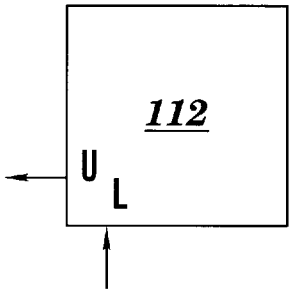

FIG. 6G illustrates the ink inlet and the ink outlet disposed on adjacent sides of the heat exchanger 110, but closely adjacent to one another at one corner of the box. In the embodiment of the heat exchanger 112 shown in FIG. 6H, the positions of the ink inlet fitting and the ink outlet fitting are once again switched with respect to the positions shown in FIG. 6G.

In the embodiment described above, the tube-in-hose heat exchange element 32 is in the form of coiled or helically wound element. However, it is possible to use a tube-in-hose heat exchange element vertically arranged in a serpentine arrangement. Such an alternative would be useful if, for example, space constraints dictated limitations on the depth of the overall unit, but not on the height or width of the overall unit. Also, other shapes or configurations of heat exchange elements are possible depending upon factors such a space constraints. In the different forms of the heat exchange element (e.g., coiled or helical and serpentine), the heat exchange element is in a non-linear winding form.

In addition, it is to be understood that the cooling liquid conduits 20, 22 can extend into the box or enclosure at a point different from where the ink carrying conduits 26, 28 enter and exit the box or enclosure. The cooling liquid conduits would then extend within the enclosure to connect with the tee connectors of the heat exchanger.

To assist in maintaining the adjacent coils in a vertically stacked or aligned manner, a U-shaped part can be provided that wraps around the adjacent coils at some point on the circumference of the coiled element 32. Of course, more than one such part can be provided.

It is preferable that the ink inlet be located at the very bottom of the hose to enable proper drainage. To avoid having the water connection flange interface with this positioning of the ink inlet, a hole can be made in the bottom of the box through which extends the water connection flange.

The present invention thus advantageously provides a fluid ink heat exchanger that is able to maintain the fluid ink at a constant temperature to avoid problems associated with fluid ink having a viscosity different from that required for optimum printing performance. The heat exchanger can be used to either cool the fluid ink to offset the heating of the ink that occurs during normal operation of the printing system, or can be used to heat the fluid ink to the necessary temperature. The heat exchanger is designed in way that facilitates cleaning because the ink side of the heat exchanger is devoid of seams and convoluted surfaces that would otherwise collect solids. Also, the ink heat exchanger is relatively compact and simple in construction. The generally concentric orientation of the tube and the hose advantageously facilitates efficient flow of heat transfer fluid. Further, efficient heat transfer can be accomplished without the need for baffles or other flow modifying devices within the heat exchange element.

In the system shown in FIG. 1, the heat exchanger 10 is positioned in series with the printing deck 14 and the ink source 12. Thus, liquid ink is conveyed in series from the ink source 12 to the heat exchanger 10 and then to the printing deck 14. However, it is also possible to position the heat exchanger 10 in parallel with the printing deck 14. In such a parallel arrangement, fluid ink would be pumped from the ink source 12 to the heat exchanger 10 and then back to the ink source 12. Temperature controlled ink in the ink source 12 would then be pumped to the printing deck 14.

As mentioned above, the tube-in-hose heat exchanger of the present invention can also be used in contexts other than printing systems involving fluid ink. The heat exchanger is particularly well suited for being used to maintain a constant temperature in other types of liquids containing suspensions, emulsions or dissolved solids which are susceptible to producing dried solids in the presence of surfaces and seams upon which the liquid can collect (e.g., adhesives and coatings).

Figure 7:
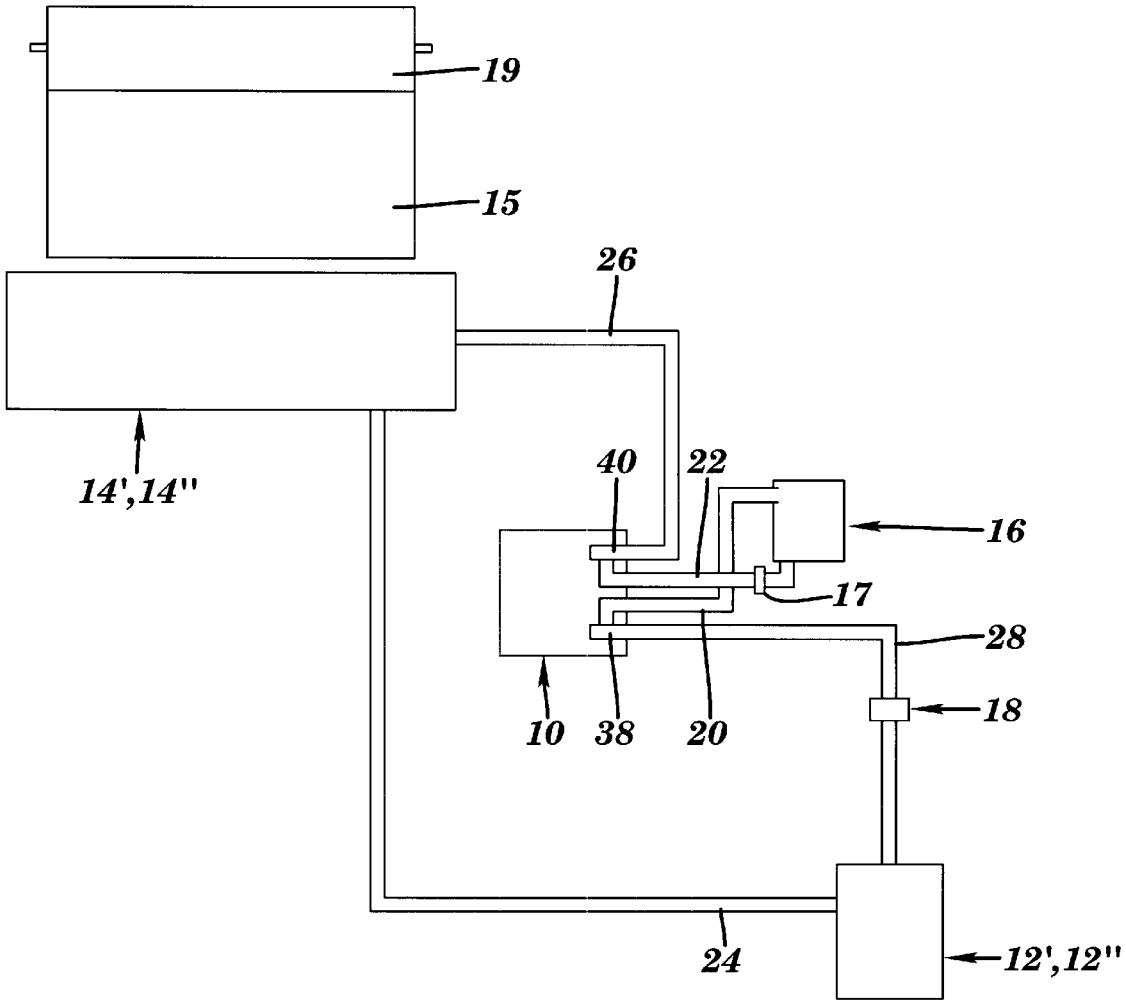
FIG. 7 is a schematic illustration of a fluid material application system embodying the heat exchanger of the present invention and adapted to apply fluid materials that include adhesives and coating to a substrate.

FIG. 7 illustrates an application system for applying adhesive or a coating onto a paper material. The system shown in FIG. 7 is the same as that shown in FIG. 1, except that instead of a fluid ink supply source and a printer deck, the system shown in FIG. 7 includes either an adhesive supply source 12' and an adhesive deck 14' or a coating supply source 12" and a coating deck 14". In all other respects, the system is configured and operated in the same general manner as that described above so that an adhesive or coating is supplied from the adhesive supply source 12' or coating supply source 12" to the heat exchanger 10 for purposes of temperature control and is then directed to the adhesive deck 14' or coating deck 14" at which the adhesive or coating is applied to, for example, a paper product 15 being unwound from a roll 19.

The heat exchanger used in the various application systems mentioned above is quite advantageous in that it can be made relatively lightweight and compact, thus allowing it to be fit into available space nearby the application deck (ink applicator, coating applicator or adhesive applicator). The efficiency of the liquid-to-liquid heat exchanger is also highly beneficial. The efficiency is so high that in many cases the ink temperature can be controlled to within a few degrees F as mentioned above by simply adjusting the temperature of the heat transfer liquid. This advantageously eliminates the need for ink temperature sensors and control valves. Also, the box or enclosure in which the heat exchanger element is located protects the heat exchange element from dirt and damage and prevents unwanted condensation. The heat exchanger also allows a great degree of versatility with respect to, for example, fitting location and orientation to easily accommodate the configuration of other elements in the fluid material application system such as the sump, the application deck and the pump. Cleanup is also greatly facilitated by virtue of the single seamless tube on the ink side. A relatively low volume of heat transfer liquid is required in the heat exchanger unit and this enables immediate usage of a warm flushing solution on the ink side once the heat transfer liquid flow is stopped. The heat exchanger is also relatively simple in design and construction and can be rather easily fabricated from readily available materials without the need for complicated and expensive elements such as extensive welding or pressure vessel certification.

The principles, preferred embodiments and operation modes of the present invention have been described in the foregoing specification. However, the invention which is intended to be protected is not to be construed as limited to the particular embodiments disclosed herein. Further, the embodiments described herein are to be regarded as illustrative rather than restrictive. Variations and changes may be made by others without departing from the spirit of the present invention. Accordingly, it is expressly intended that all such variations and changes fall within the spirit and scope of the present invention and are embraced thereby.

What is claimed is:

1. A fluid material application system for applying one of printing ink, adhesive and a coating to a paper product comprising:

a fluid material source containing fluid material that is one of fluid ink, adhesive and a coating;

a heat transfer fluid source containing heat transfer fluid;

heat exchanger that includes a heat exchange element comprised of a hose for carrying the heat transfer fluid and a tube for carrying the fluid material, said tube being positioned within the hose, said heat exchange element possessing a winding configuration with adjacent portions of the heat exchange element resting on top of one another so that the adjacent portions are supported in a vertical fashion;

an application deck for applying the fluid material to said paper product;

a fluid material supply conduit connecting the fluid material source to an inlet of the tube to carry the fluid material from the fluid material source to the heat exchanger;

a fluid material introduction conduit connecting an outlet of the tube to the application deck to carry fluid material from the heat exchanger to the application deck;

a heat transfer fluid supply conduit connecting the heat transfer fluid source to an inlet of the hose to carry heat transfer fluid to the heat exchange element;

a heat transfer fluid return conduit connecting an outlet of the hose to the heat transfer fluid source to carry heat transfer fluid from the heat exchange element to the heat transfer fluid source; and a fluid material return conduit connecting the application deck to the fluid material source to return fluid material from the application deck to the fluid material source.

2. The fluid material application system of claim 1, wherein the heat exchange element is positioned within a box.

3. The fluid material application system of claim 1, wherein said hose is a flexible hose and said tube is a seamless metal tube.

4. The fluid material application system of claim 1, including a pump connected to the fluid material introduction conduit to pump fluid ink from the fluid material source to the heat exchange element.

5. The fluid material application system of claim 1, wherein said outlet of the tube and said inlet of the hose are positioned at one end of said heat exchange element, and said inlet of the tube and said outlet of the hose are positioned at an opposite end of said heat exchange element so that the fluid material and the heat transfer fluid flow in opposite directions within the heat exchange element.

6. The fluid material application system of claim 1, including a pump connected to the heat transfer fluid supply conduit to pump heat transfer fluid from the heat transfer fluid source to the heat exchange element.

7. The fluid material application system of claim 1, wherein said heat exchange element is positioned within an enclosure having a plurality of walls, said fluid material supply conduit being connected to the outlet of the tube by a material fluid outlet fitting and said fluid material introduction conduit being connected to the inlet of the tube by a fluid material inlet fitting.

8. The fluid material application system of claim 7, wherein said fluid material inlet fitting and said fluid material outlet fitting extend through the same wall of the enclosure.

9. The fluid material application system of claim 7, wherein said fluid material inlet fitting and said fluid material outlet fitting extend through different walls of the enclosure.

10. The fluid material application system of claim 7, wherein said fluid material inlet fitting and said fluid material outlet fitting extend through opposite walls of the enclosure.

11. A fluid material application system for applying one of printing ink, adhesive and a coating to a substrate comprising:

a fluid material source containing fluid material that is one of printing ink, adhesive and a coating, said fluid material source being connected to an application deck;

a heat transfer fluid source;

said application deck comprising a printing plate or coating roller and being capable of flexographic, gravure, hydrophilic or rod coater application of the fluid material to a substrate; and a heat exchange element comprised of a tube positioned within a hose, the tube and the hose both having a central axis, the central axis of the tube being generally parallel to the central axis of the hose, the tube being connected to the fluid material source to carry the fluid material through the heat exchange element and the hose being connected to the heat transfer fluid source to carry heat transfer fluid through the heat exchange element.

12. The fluid material application system of claim 11, wherein said heat exchange element comprised of said tube and said hose is wound so that the heat exchange element possesses a compact arrangement.

13. The fluid material application system of claim 11, wherein said heat exchange element comprised of said tube and said hose is helically wound in a coiled manner within an enclosure, with adjacent coils resting on top of one another so that the coils are supported in a vertical fashion.

14. The fluid material application system of claim 11, wherein the fluid material source is connected to an inlet of the tube by a first conduit and an outlet of the tube is connected to the application deck by a second conduit.

15. The fluid material application system of claim 14, wherein the heat transfer fluid source is connected to an inlet of the hose by a third conduit and an outlet of the hose is connected to the heat transfer fluid source by a fourth conduit to return heat transfer fluid from the heat exchange element to the heat transfer fluid source.

16. The fluid material application system of claim 14, including a pump connected to the first conduit to pump the fluid material from the fluid material source to the heat exchange element.

17. The fluid material application system of claim 11, wherein said hose is a flexible hose and said tube is a seamless metal tube.

18. The fluid material application system of claim 11, wherein an outlet of said tube is connected to the application deck and an inlet of the hose is connected to the heat transfer fluid source, said outlet of the tube and said inlet of the hose being positioned at one end of said heat exchange element, said tube having an inlet connected to said fluid material source and said hose having an outlet connected to the heat transfer fluid source, said inlet of the tube and said outlet of the hose being positioned at an opposite end of said heat exchange element so that the fluid material and the heat transfer fluid flow in opposite directions within the heat exchange element.

19. The fluid material application system of claim 11, wherein said fluid material source is connected to said heat exchange element and said heat exchange element is connected to said application deck so that the fluid material is directed from the fluid material source to the heat exchange element and from the heat exchange element to the application deck.

20. A fluid material application system for applying one of printing ink, adhesive and a coating to a substrate comprising:

a fluid material source containing fluid material that is one of printing ink, adhesive and a coating, said fluid material source being connected to an application deck for applying the fluid material to a substrate;

a heat transfer fluid source; and a heat exchange element comprised of a tube positioned within a hose, the tube and the hose both having a central axis, the central axis of the tube being generally parallel to the central axis of the hose, the tube being connected to the fluid material source to carry the fluid material through the heat exchange element and the hose being connected to the heat transfer fluid source to carry heat transfer fluid through the heat exchange element, wherein the fluid material source is connected to an inlet of the tube by a first conduit and an outlet of the tube is connected to the application deck by a second conduit and the application deck is connected to the fluid material source by a return fluid material conduit to return fluid material from the application deck to the fluid material source.

* * * * *